US005497599A

United States Patent [19]

Hirobe

[11] Patent Number: 5,497,599

[45] Date of Patent: Mar. 12, 1996

[54] DEVICE FOR SUPPLYING FILM FOR A PACKAGING MACHINE

[75] Inventor: Kenji Hirobe, Shiga, Japan

[73] Assignee: Ishida Co., Ltd., Japan

[21] Appl. No.: 371,062

[22] Filed: Jan. 10, 1995

Related U.S. Application Data

[63] Continuation of Ser. No. 165,145, Dec. 10, 1993, abandoned.

[30] Foreign Application Priority Data

Dec. 17, 1993 [JP] Japan ..... 4-355503

[51] Int. Cl.[6] ..... B65B 91/00

[52] U.S. Cl. ..... 53/389.3; 53/520; 53/168

[58] Field of Search ..... 53/520, 389.2, 53/119, 168, 389.3, 504

[56] References Cited

U.S. PATENT DOCUMENTS

| | | | |
|---|---|---|---|
| 4,458,470 | 6/1984 | Fine | 53/502 |
| 4,586,321 | 5/1986 | Costa | 53/520 |
| 4,726,173 | 2/1988 | Gratti | 53/389.3 |
| 5,205,104 | 4/1993 | Nakashima et al. | 53/504 |
| 5,333,803 | 8/1994 | Planeta | 242/555.3 |

FOREIGN PATENT DOCUMENTS

| | | |
|---|---|---|
| 0403200 | 6/1990 | European Pat. Off. . |
| 0622617 | 5/1994 | European Pat. Off. . |
| 1963956 | 12/1969 | Germany . |
| 2080240 | 7/1981 | United Kingdom . |

*Primary Examiner*—John Sipos
*Assistant Examiner*—Gene L. Kim
*Attorney, Agent, or Firm*—Majestic, Parsons, Siebert & Hsue

[57] ABSTRACT

A device for supplying a film to a packaging machine has a gripper for gripping the film and a transporting mechanism for not only moving the gripper between a film feeder of the packaging machine, which receives the film from the gripper and takes it to a packaging station for using it to wrap up a product, and a retracted position distal from the film feeder, but also keeping the gripper retracted while the film feeder carries the film to the packaging station.

20 Claims, 11 Drawing Sheets

DEVICE FOR SUPPLYING FILM FOR A PACKAGING MACHINE

This is a continuation of application Ser. No. 08/165,145 filed Dec.10, 1993, now abandoned.

BACKGROUND OF THE INVENTION

This invention relates broadly to a packaging machine installed, for example, at a packing center for producing a packaged product by wrapping up an article or articles placed on a tray by using a film piece. More particularly, this invention relates to a device for supplying such a film piece as a part of such a packaging machine.

Packaging machines of the kind using a stretch film to package products placed on a tray are commonly used at packing centers for products to be sold at supermarkets. A packaging machine of this kind (described, for example, in Japanese Patent Publication Tokkai 63-218025) is typically so structured that a film in the form of a web is pulled from a film roll to a packaging station above the product to be packaged and is used to wrap up the product after it is cut to a specified length. A prior art film supplying device for such a packaging machine may be characterized, as shown in FIG. 13, as having a film roll FL and a film feeder 6 such that a film F which is pulled out from the film roll FL is guided to the film feeder 6 and is thereby kept stretched. Clamps (not shown) for the film F are provided on both sides of the film feeder 6, and these clamps are adapted to move to the right (with reference to the figure) from the film feeder 6 to grip the film F and thereafter to return towards the film feeder 6, thereby supplying the film F to the film feeder 6. The film F is thereafter cut by means of a cutter 21.

According to the prior art technology described above, however, each cycle of the film supply operation takes a relatively long time because the clamps provided to the film feeder 6 must first move towards the film F and then back towards the film feeder 6. As a result, the period of the cyclic packaging operations cannot be shortened.

SUMMARY OF THE INVENTION

In view of the above, it is an object of the present invention to provide a device for supplying film for a packaging machine capable of reducing the period of the cyclic film-supplying operation.

A film supplying device embodying the present invention, with which the above and other objects can be accomplished, may be characterized as comprising film gripper means for gripping front end parts of a film and gripper transporting means for moving the aforementioned film gripper means. The gripper transporting means are adapted to transport the film gripper means to a film receiving section of the film feeder along the path of the pulled-out film and to thereby insert the film into the film receiving section of the film feeder. Additionally, the gripper transporting means are adapted to retract the film gripper means while the film is being pulled out by the film feeder.

With a device thus structured, the film gripper means can be brought to the film receiving part of the film feeder as soon as a cycle of packaging operation is completed because it is retracted by the gripper transporting means while the film is being unwound by the film feeder. Thus the next supply of the film can be started immediately.

BRIEF DESCRIPTION OF THE DRAWINGS

The accompanying drawings, which are incorporated in and form a part of this specification, illustrate an embodiment of the invention and, together with the description, serve to explain the principles of the invention. In the drawings.

DETAILED DESCRIPTION OF THE INVENTION

Figure 1:
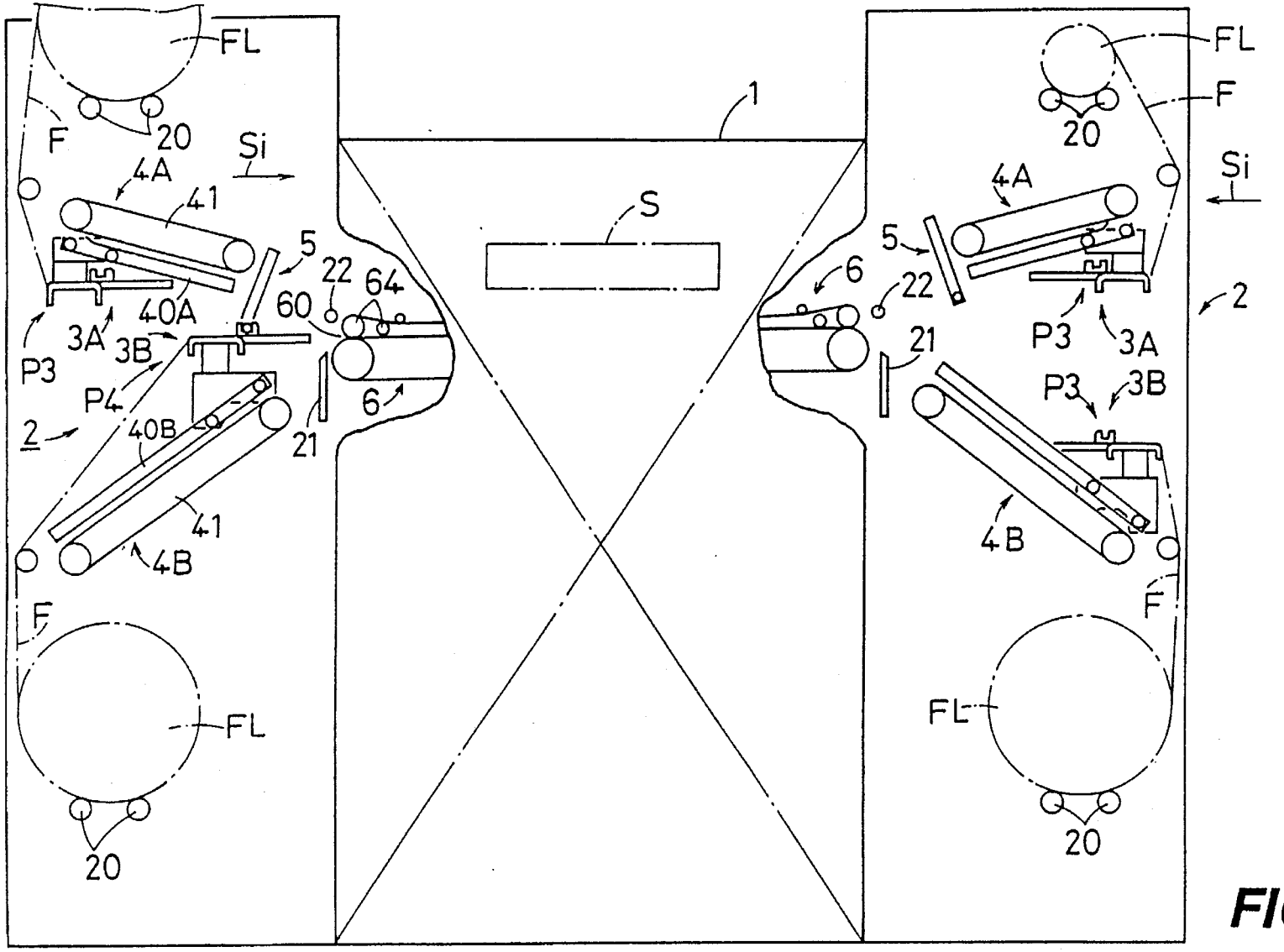
FIG. 1 is a schematic diagram showing the layout of some principal components of a packaging machine with a pair of film supplying devices embodying the present invention.

FIG. 1 is a schematic of a packaging machine with film supplying means embodying the invention, showing in particular the layout of some of the principal components of the film supplying means as seen from the front.

As shown in FIG. 1, the packaging machine is provided with a pair of film supplying devices 2, flanking the main structure 1 (of the packaging machine) from the left and the right. Since these two devices 2 are symmetrically structured and disposed with respect to the main structure 1 therebetween at the center of the packaging machine, only one of the film supplying device 2 on the left-hand side will be described in detail below.

With reference still to FIG. 1, each of the pair of film supplying devices 2 contains two film rolls FL (typically of different lengths to provide films of different widths) at positions somewhat distal from the packaging station S inside the main structure 1 of the packaging machine, both rolls FL extending in the front-to-back direction, one at a position higher than a film feeder 6 and the other at another position lower than the film feeder 6. Each film roll FL is supported by a pair of support rollers 20. These pairs of support rollers 20 are rotationally driven by motors (not shown) such that films F can be pulled out of these film rolls FL.

Figure 2:
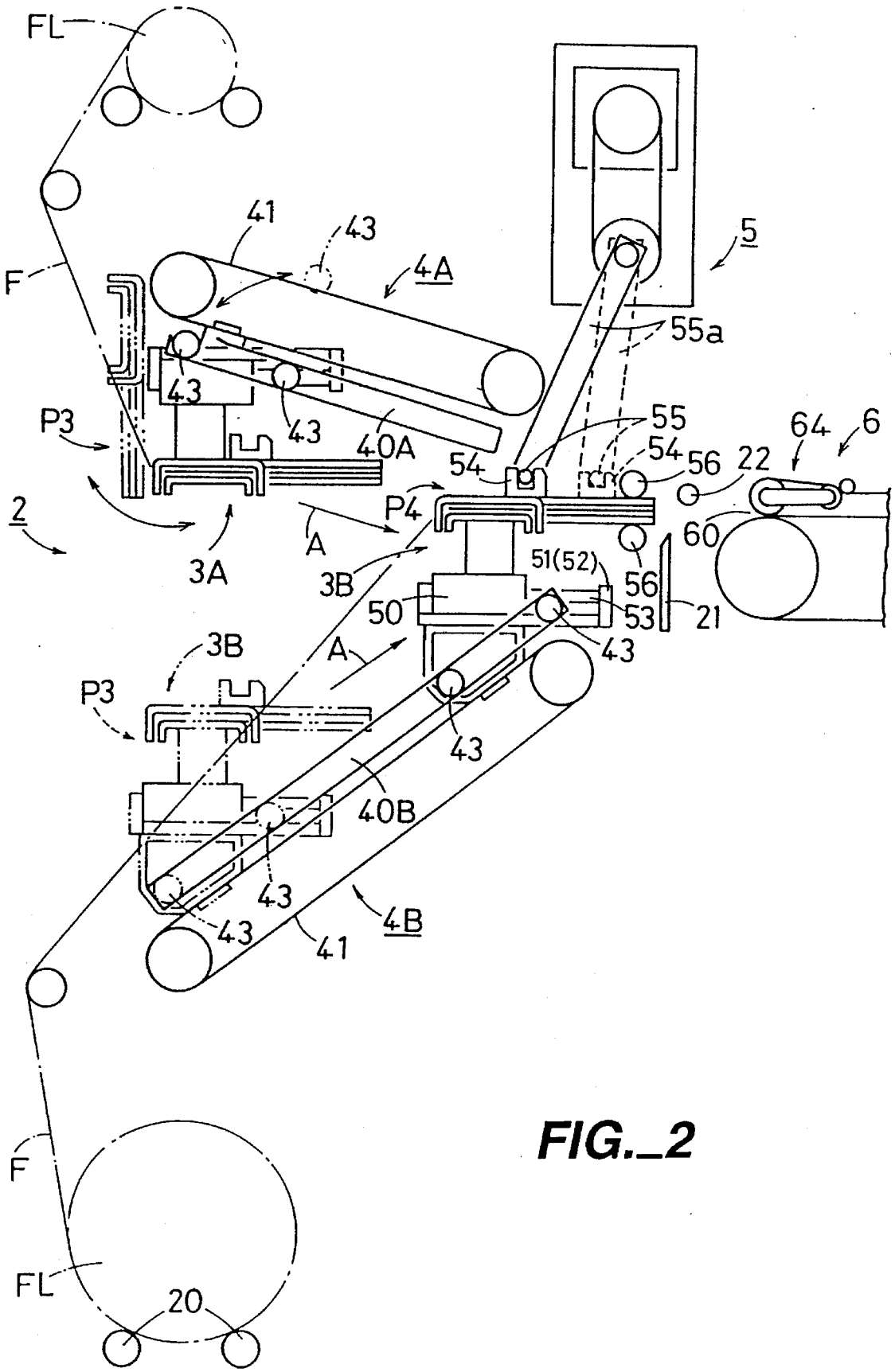
FIG. 2 is a schematic conceptual diagram of the film supplying device of FIG. 1.

As shown more clearly in FIG. 2, each of the pair of film supplying devices 2 is provided with two similarly structured sets of film grippers 3A and 3B, each associated with one of the two film rolls FL and adapted to move diagonally along a guide rail 40A or 40B. Next, the structure of the lower set of film grippers 3B will be described in detail with reference to FIG. 3, the upper set of film grippers 3A being similarly structured.

Figure 3:
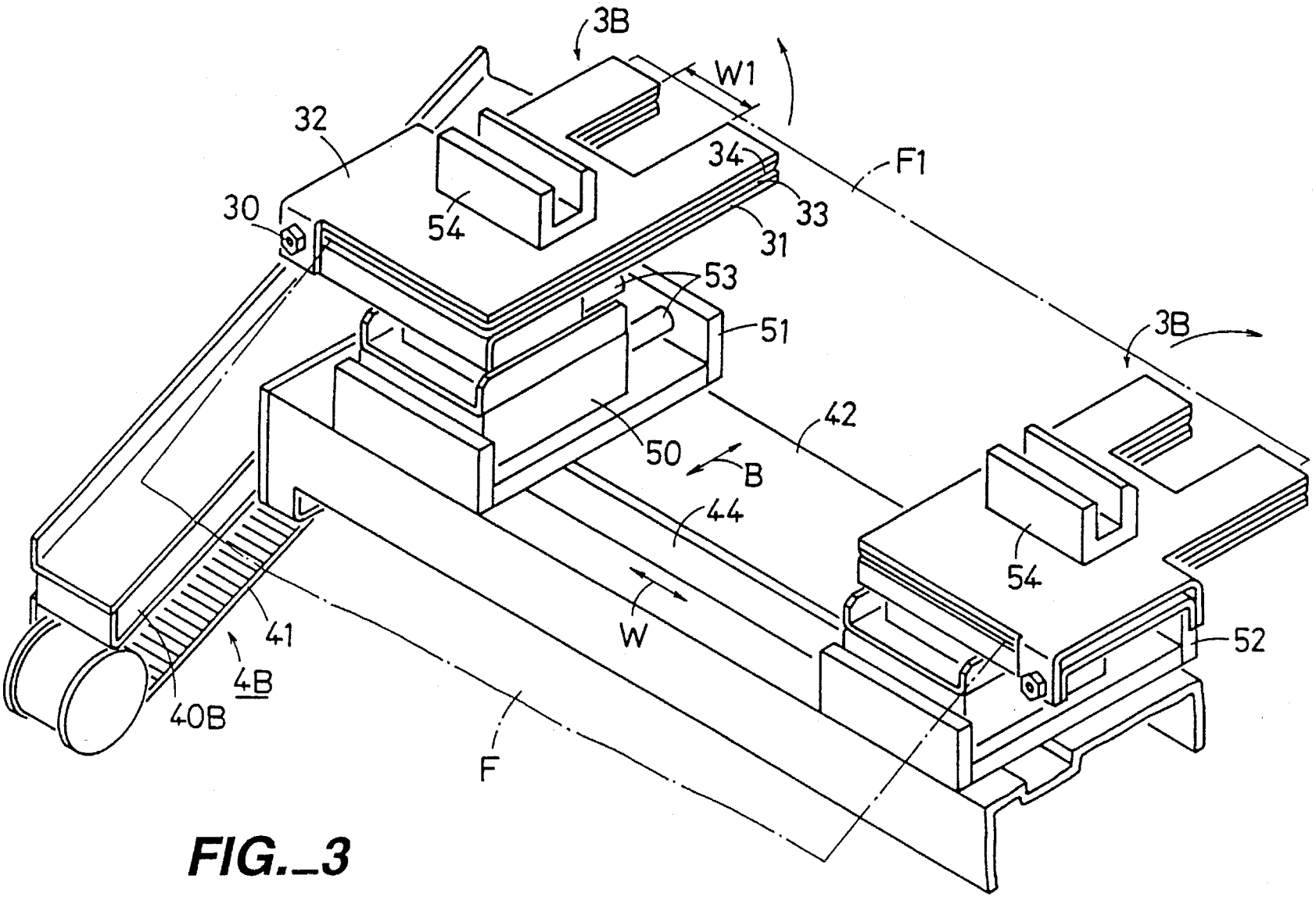
FIG. 3 is a schematic diagonal view of the gripper and the gripper transporting mechanism of FIG. 2.

As shown in FIG. 3, the two grippers 3B (of the lower set) are symmetrically disposed, one on the right-hand side and the other on the left-hand side of the film F to be supplied, both adapted to grip the front edge of the film F. Each gripper 3B is provided with a lower gripper plate 31 fastened to a slider 50 and an upper gripper plate 32 which is rotatably connected to the lower gripper plate 31 around a hinge 30.

Figure 4:
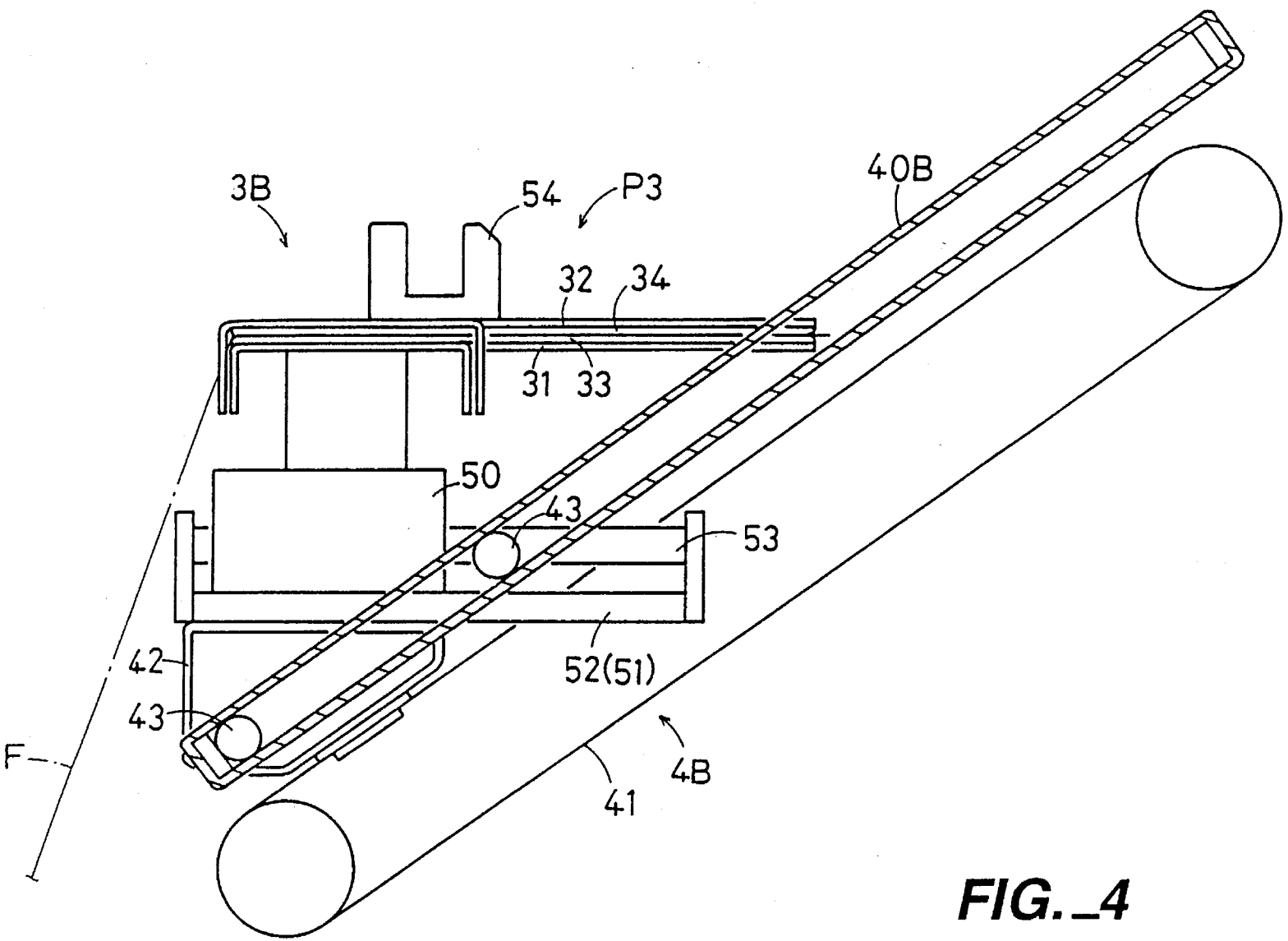
FIG. 4 is a schematic sectional front view of the lower one of the first gripper transporting devices.

As shown more clearly in FIG. 4, rubber plates 33 and 34 are attached respectively to the lower and upper gripper plates 31 and 32 such that the film F is gripped between the two rubber plates 33 and 34 by the weight of the upper gripper plate 32. As shown in FIG. 2, the upper and lower sets of film grippers 3A and 3B are adapted to be transported along the paths of travel by the films F as shown by arrows A to a film receiving section 60 of the film feeder 6 by means of first gripper transporting devices 4A and 4B and a second gripper transporting device 5.

The first gripper transporting devices 4A and 4B each include a gripper transporting belt 41 which is rotationally driven by a motor (not shown) and the aforementioned guide rail 40A or 40B disposed parallel thereto. As shown in FIG. 3. an elevator frame 42 is attached to each of the gripper transporting belt 41, and travel rollers 43 are rotatably attached to each of end parts of the elevator frame 42 so as to be guided by the guide rail 40A or 40B as shown in FIG. 2 and to rotate and move therealong.

With reference next to FIG. 3, the elevator frame 42 has a fixed base 51 affixed thereonto on one side (left-hand side in FIG. 3) and a slidable base 52 on the opposite side. The slidable base 52 is made slidable in the direction W of the width of the film roll FL by engaging with a guide groove 44 formed on the elevator frame 42. Both the fixed base 51 and the slidable base 52 are provided with guide rods 53 such that the aforementioned slider 50 can slide along each in a direction shown by arrow B perpendicular to the direction W of the width of the film roll FL. The upper gripper plate 32 is provided with a sectionally U-shaped, grooved engaging piece 54.

Figure 5:
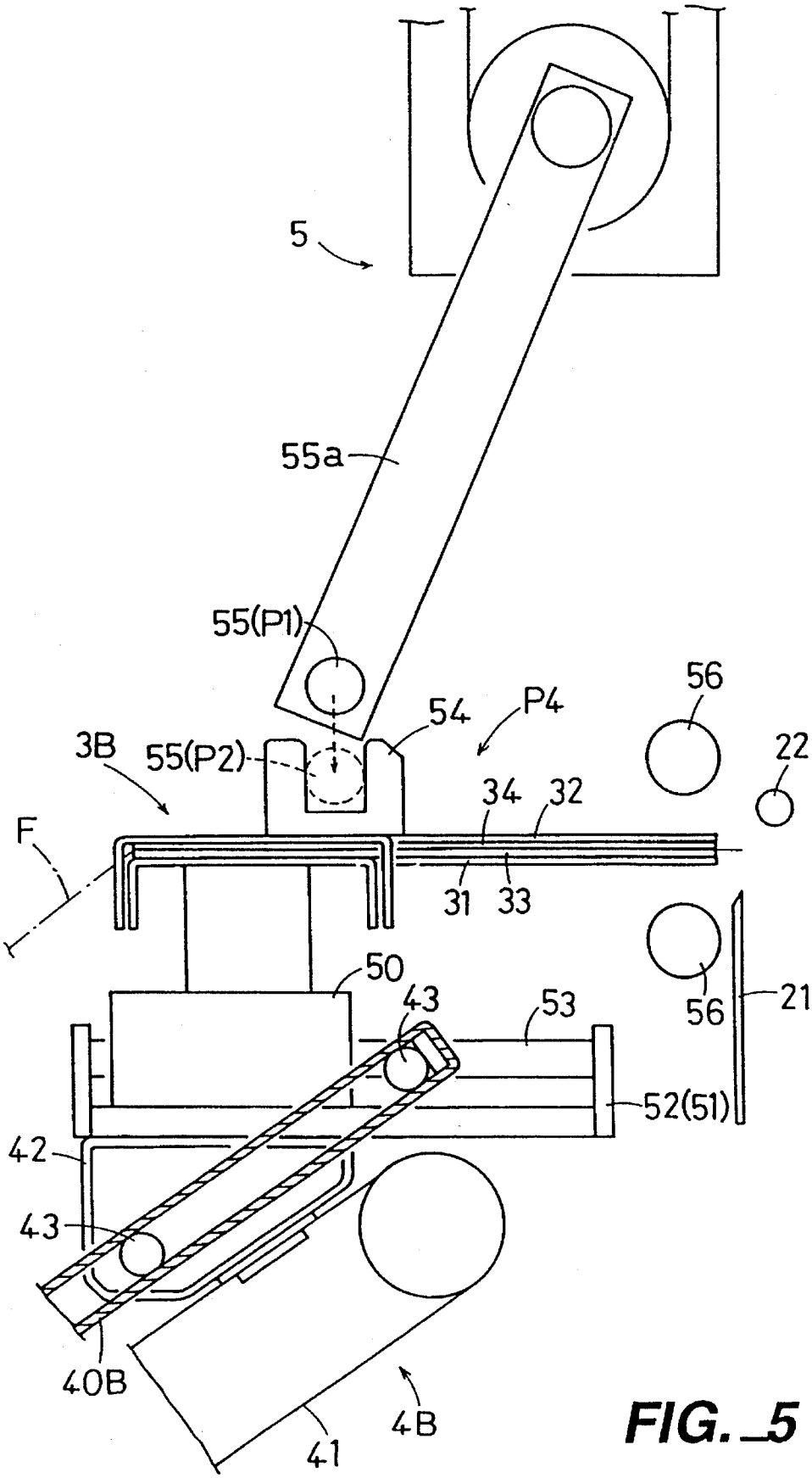
FIG. 5 is a schematic sectional front view of the second gripper transporting device.

As shown in FIG. 2, the second gripper transporting device 5 includes an arm 55*a* having at its end a pin 55 for engaging with the aforementioned grooved engaging piece 54. The arm 55*a* can be raised or lowered and also can freely swing. In particular, it can be lowered, as shown in FIG. 5, to move the pin 55 from its disengaged position P1 (shown by solid line) to an engaged position P2 (shown by broken line) thereby becoming engaged with the grooved engaging piece 54. If the arm 55*a* is rotated by some angle in the counter-clockwise direction while the pin 55 is in this engaged position P2, the film gripper 3B can be shifted to the right.

Figure 6:
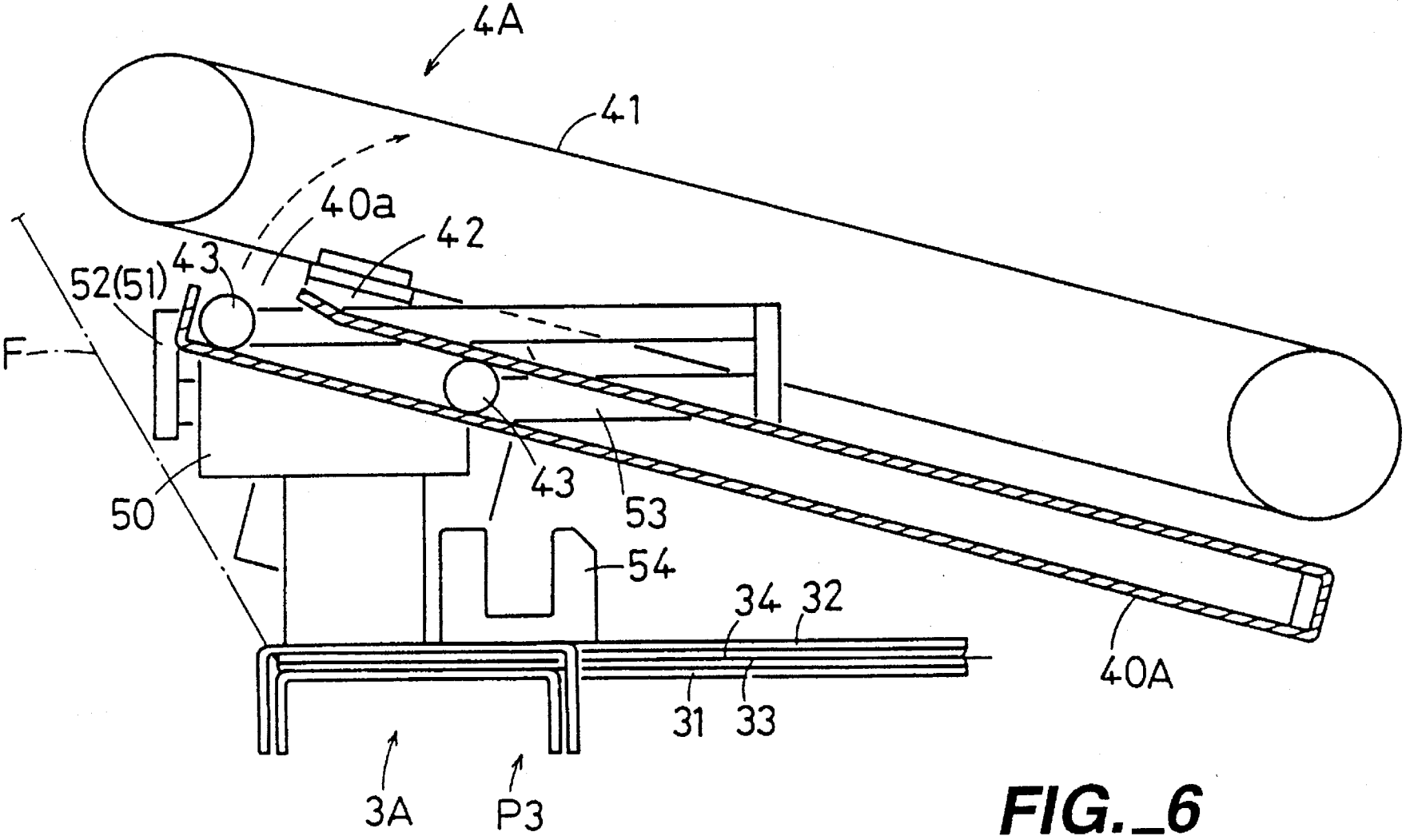
FIG. 6 is a schematic sectional front view of the upper one of the first gripper transporting devices.
Figure 7:
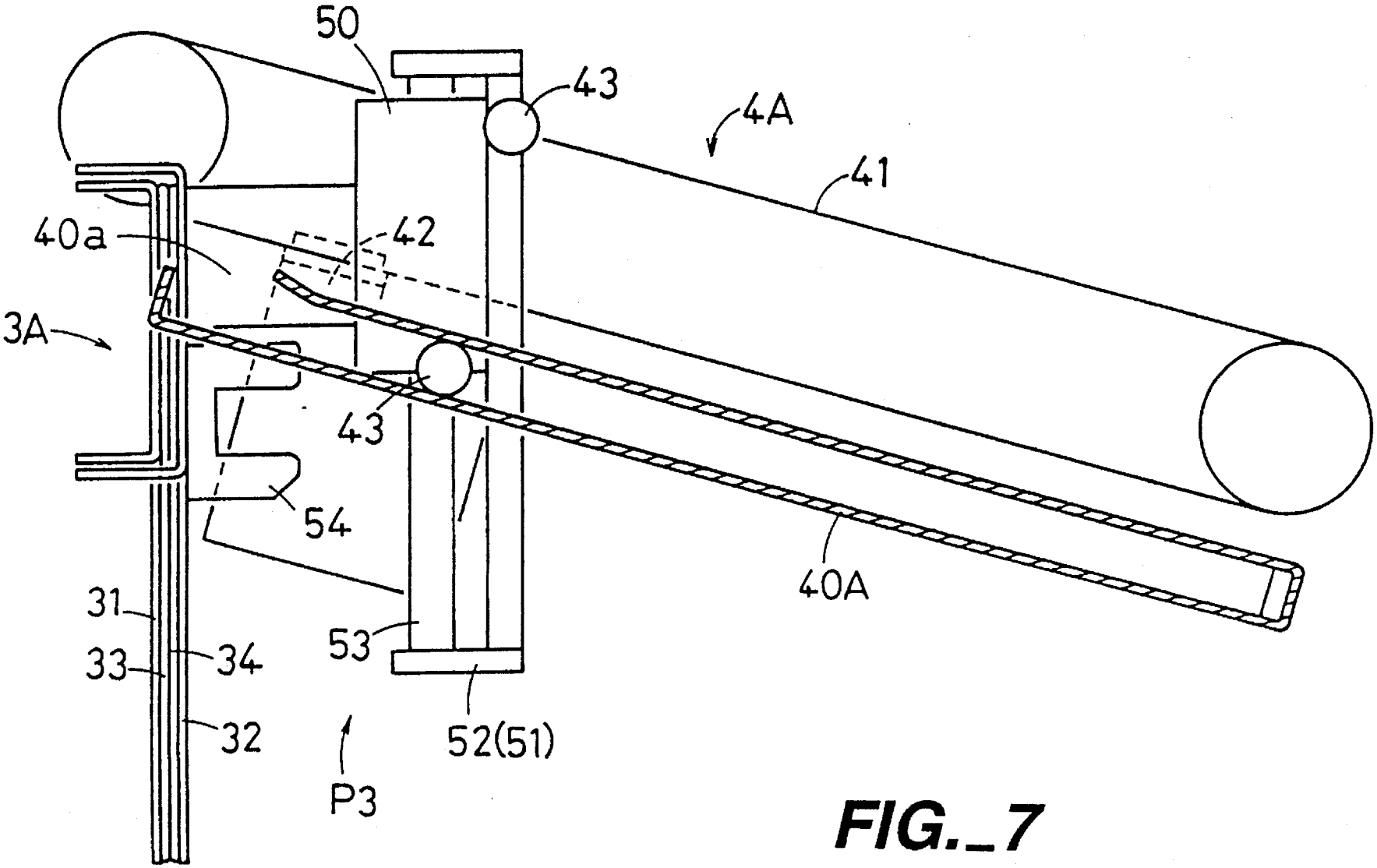
FIG. 7 is a schematic sectional front view of the upper one of the first gripper transporting devices when the gripper is in the rotated condition.

With reference next to FIG. 6, the guide rail 40A has an opening on the upper side of its retracting end 40*a*. When the travel rollers 43 are all the way back at the retracting end 40*a* as shown in FIG. 6, one of the travel rollers 43 (at the retracting end 40a) and the film gripper 3A rotate by their own weight around the other of the travel rollers 43 by about 90° as indicated by broken arrow to a position shown in FIG. 7.

Figure 8:
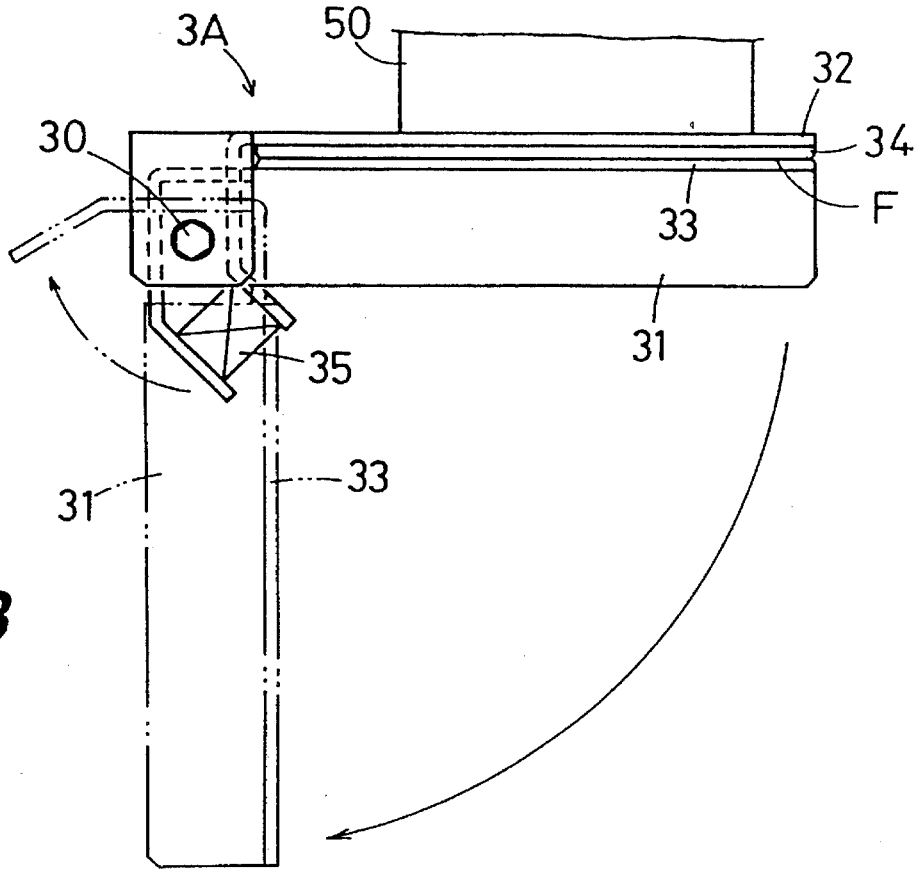
FIG. 8 is a side view of the upper one of the first gripper transporting devices.
Figure 13:
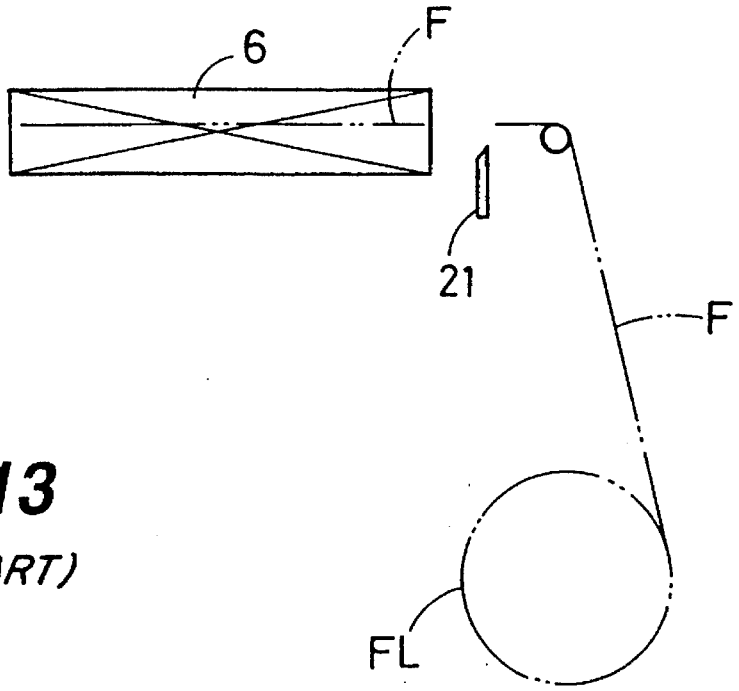
FIG. 13 (PRIOR ART)
FIG. 13 is a conceptual diagram for a prior art film supplying method.

As shown in FIG. 8, the upper film gripper 3A has its lower gripper plate 31 rotatably attached to its upper gripper plate 32. The lower gripper plate 31 is provided with a permanent magnet 35 such that the film F is fastened by its magnetic force between the upper and lower gripper plates 31 and 32 as shown by solid lines.

Figure 9:
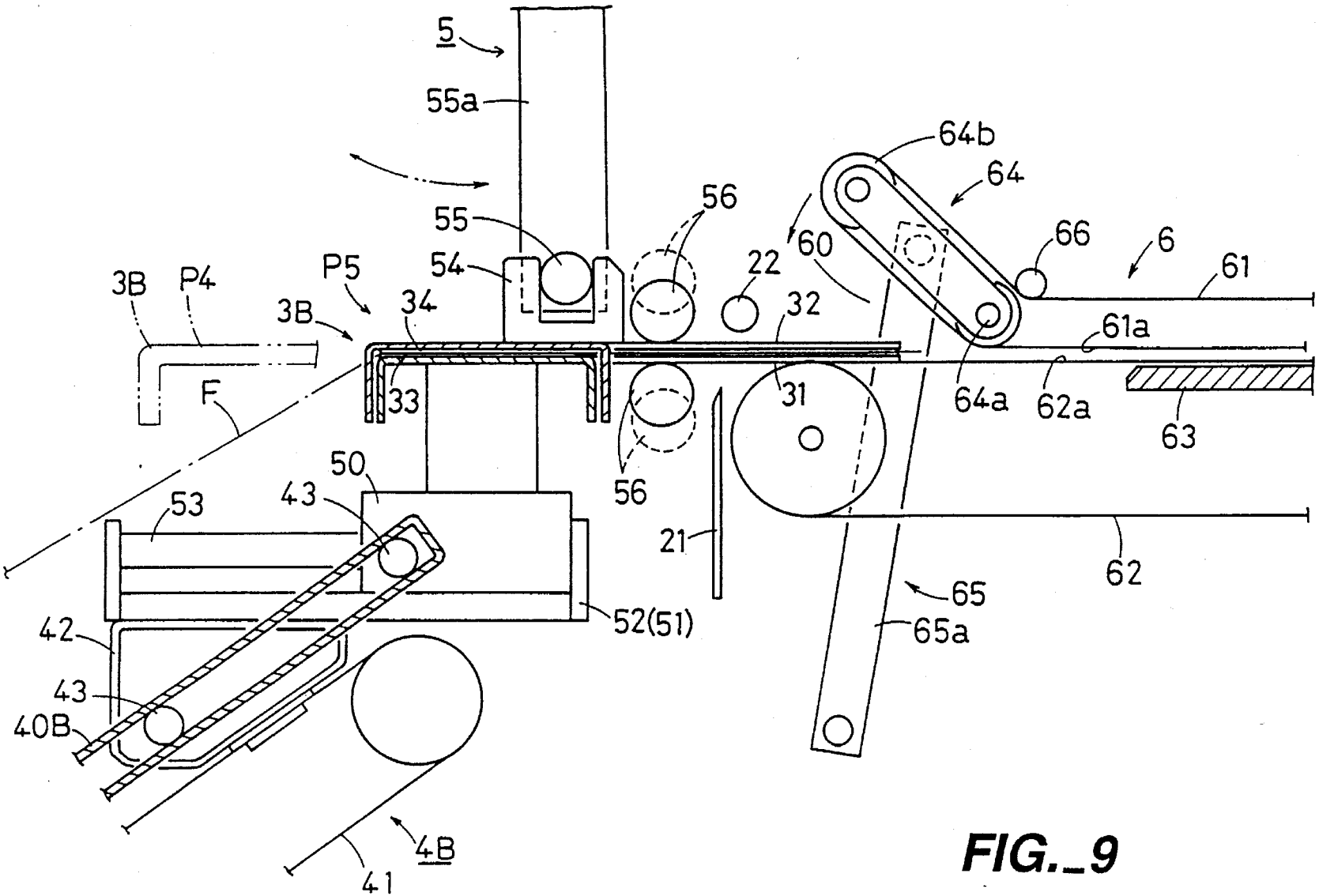
FIG. 9 is a schematic sectional view for showing how a film is transported from the grippers to the film feeder.

Near the film receiving section 60 of the film feeder 6, there are provided, as shown in FIG. 9, a pair of upper and lower positioning rollers 56, a cutter 21 for cutting the film, and a fixed member 22 for holding the film downward in position as the cutter 21 swings upward to cut it. The positioning rollers 56 are movable vertically upward and downward and are kept in retracted positions shown by broken lines while the film gripper 3B (or 3A) moves up (or down) to a wait position P4 indicated by a broken line. After the film gripper 3B (or 3A) reaches the wait position P4 (also shown in FIG. 5), the positioning rollers 56 move towards each other as shown by solid lines in FIG. 9 to sandwich the lower and upper gripper plates 31 and 32 of the film gripper 3B (or 3A) for positioning. The positioning rollers 56 are rotatably supported and serve to guide the motion of the film gripper 3B (or 3A) to the right (with reference to FIG. 9) towards the film feeder 6. The cutter 21 serves to cut the film F by moving vertically upward after the film gripper 3B has been retracted.

The film feeder 6 is for transporting the film F to a position below the packing station S (shown in FIG. 1) and is provided with an upper belt 61 and a lower belt 62. These belts 61 and 62 are driven by a motor (not shown), and their belt surfaces 61*a* and 62*a* are proximate and opposite to each other. Below the lower belt 62 is a mobile push-up plate 63 for pushing its belt surface 62*a* against the belt surface 61*a* of the upper belt 61. This mobile push-up plate 63 can be pushed upward through a link mechanism connecting it to an electromagnetic valve (not shown) such that the belt surfaces 61*a* and 62*a* are pressed to each other and the film F is tightly sandwiched therebetween.

Figure 10:
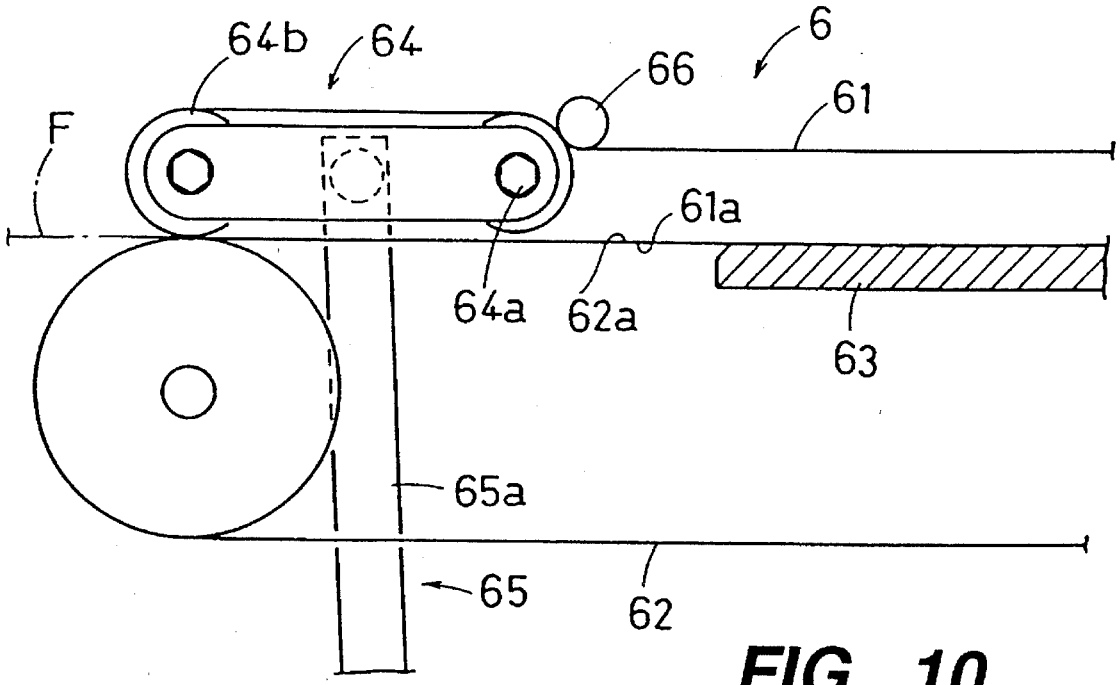
FIG. 10 is a front view of an end section of the film feeder.
Figure 11:
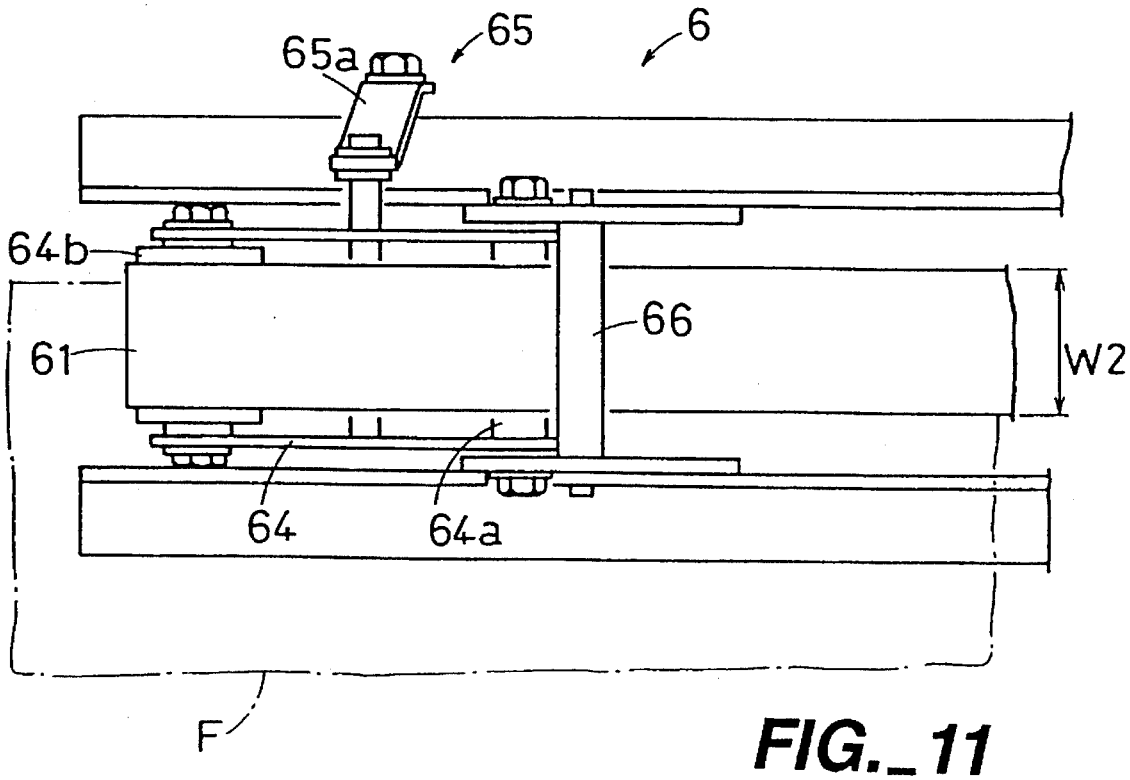
FIG. 11 is a plan view of the end section shown in FIG. 10.

A film receiving mechanism 64 is provided at both end parts of the upper belt 61. Each film receiving mechanism 64 includes an end roller 64*b* which is supported rotatably around a pin 64a and normally assumes an open position shown in FIG. 9 by the biasing force of a spring (not shown) on a link 65*a* of a linkage mechanism 65. If the link 65*a* is pulled downward by the operation of an electromagnetic valve (not shown), the film receiving mechanism 64 comes to contact the belt surface 62*a* of the lower belt 62 to sandwich the film F therebetween as shown in FIG. 10. The width W2 of the belts 61 and 62 (as indicated in FIG. 11) is substantially smaller than the width W1 of an indented portion of the film grippers 3A and 3B as indicated in FIG. 3 such that there is no interference of motion between the film grippers 3A and 3B and the belts 61 and 62. Numeral 66 in FIGS. 9, 10 and 11 indicates a tension roller which serves to control the tension inside the upper belt 61.

Figure 12:
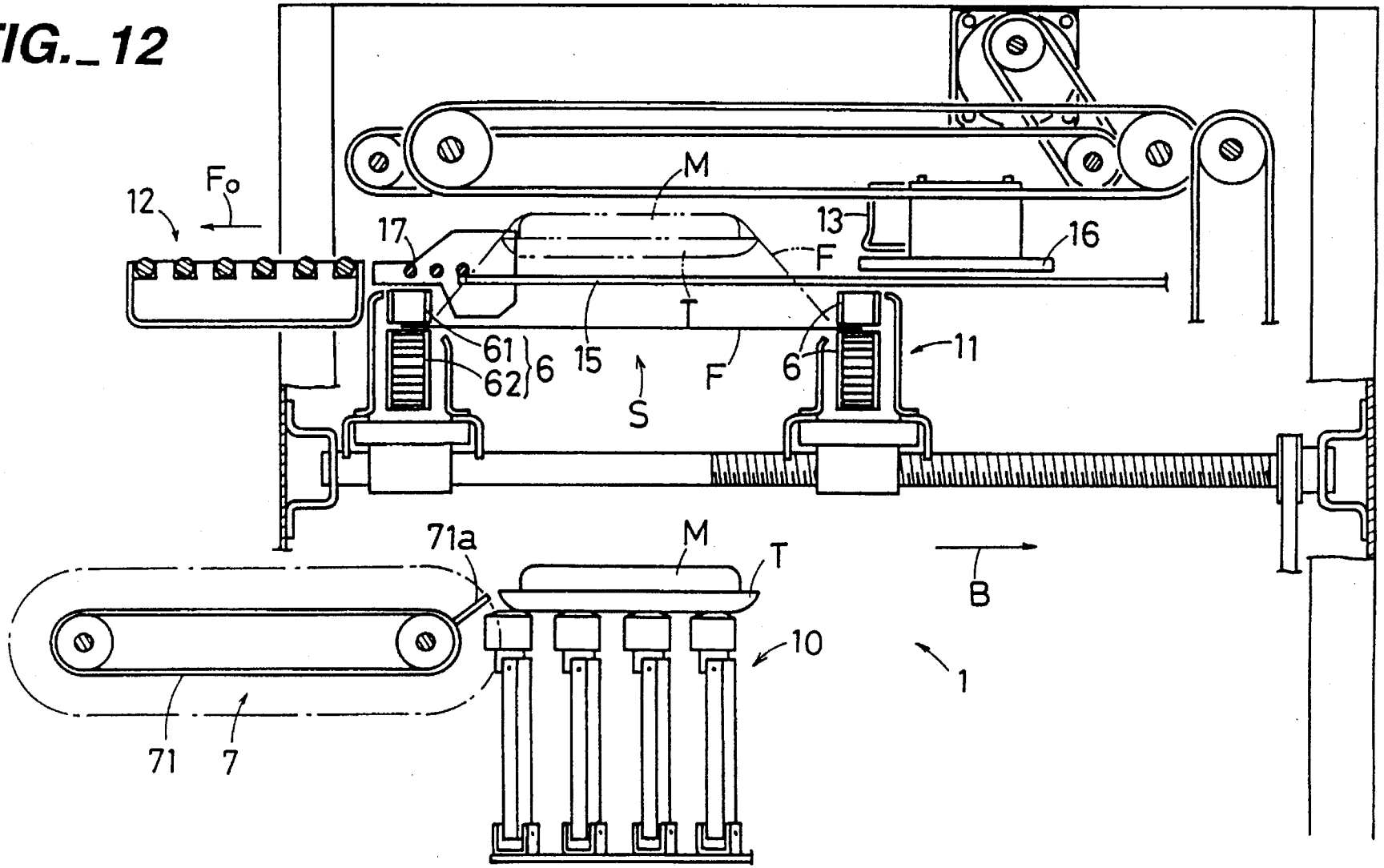
FIG. 12 is a schematic side sectional view of the main structure of the packaging machine of FIG. 1.

As shown in FIG. 12, which is a sectional view of the main structure 1 of the packaging machine, the packaging machine itself is provided with a weighing conveyer 7 having a weight detecting means such as a load cell and serving to measure the weight of a product M placed on a tray T. The weighing conveyer 7 includes a motor-driven belt 71 having a pusher 71*a* attached thereto which serves to push the rear end of the tray T such that the product M is guided to a lifter 10 together with the tray T. Above the lifter 10 is a packaging mechanism 11 which serves to wrap up the product M together with the tray S in a film F at the aforementioned packaging station S. In front (in the forward direction $F_0$) of the packaging station S is a sealing device 12 which serves to thermally seal the film F folded downward towards the bottom of the tray T. The packaged product M is pushed forward $F_0$ from behind by a pusher 13 and is discharged to the sealing device 12.

To explain the components of the packaging machine more in detail, the lifter 10 is disposed directly beneath the packaging station S and is movable vertically upward and downward. When a product M is brought to the lifter 10 from the weighing conveyer 7, the lifter 10 raises it and pushes it upward against the lower surface of the film F, which has been preliminarily transported to the packaging station S in a clamped condition by the film feeder 6 and is maintained in a stretched condition. The film F and the top surface of the product M come into an air-tight contact with each other as the product M is lifted by the lifter 10. Under this condition, the front, back and side edges of the film F are folded towards the bottom surface of the tray T to completely package the product M.

For this purpose, the aforementioned packaging mechanism 11 is provided with a pair of side edge folding plates (only one of the pair being shown in FIG. 12 at 15), a back edge folding plate 16 and a rod-shaped front edge folding member 17. The side edge and back edge folding plates 15 and 16 are adapted to fold the film F downward towards the bottom surface of the tray T. As the pusher 13 is driven at a specified timing with respect to the motion of the side and back edge folding plates 15 and 16 to discharge the product M, the front folding member 17 serves to fold the front edge portion of the film F downward towards the bottom surface of the tray T.

Next, the operation of the packaging machine is explained more in detail. First, film rolls FL of specified lengths are loaded on support rollers 20 of FIG. 1. For the lower film roll FL, for example, the slidable base 52 for the right-hand film gripper 3B is moved according to the length of the film roll FL as shown in FIG. 3 (matching the width of the film F). Thereafter, the upper gripper plate 32 is opened by rotating it around the hinge 30, and the both side edge portions of the front edge F1 of the film F is inserted between the upper and lower gripper plates 31 and 32. The upper film roll FL is similarly prepared. After the films F are thus gripped, let us assume that the user wishes to use the film F from the lower film roll FL for packaging. The gripper transporting belt 41 of the first gripper transporting device 4B is activated such that the film grippers 3B are raised from their film-setting position (indicated by P3 in FIG. 4) to the wait position (indicated by P4 shown in FIG. 5) while the film F remains gripped thereby. Next, the positioning rollers 56 are moved towards each other, and the arm 55*a* of the second gripper transporting device 5 moves downward by a small distance so as to cause the pin 55 to be received by and engage the grooved piece 54. After this engagement is accomplished, the arm 55*a* swings a little in the counter-clockwise direction to cause the slider 50 of the film gripper 3B to move to the right (with reference to FIG. 9) along the guide rods 53 and the film grippers 3B to slide to a film-supplying position (indicated by P5 in FIG. 9). The first and second gripper transporting devices 4B and 5 thus transport the film grippers 3B along the path of travel of the film F to the film receiving section 60 of the film feeder 6 and cause the film F to be inserted into the film receiving section 60 of the film feeder 6. At this moment, the film receiving mechanism 64 of the film feeder 6 is in the open condition.

After the film F is thus inserted, an electromagnetic valve (not shown) is activated to thereby cause the end roller 64*b* to rotate around the pin 64*a* by means of the link 65*a* such that the film F is sandwiched between the upper and lower belts 61 and 62. At the same time, the mobile push-up plate 63 is raised as shown in FIG. 10 so as to cause the upper and lower belt surfaces 61*a* and 62*a* to contact each other. Since the force by which the film F is gripped by the film grippers 3B is due only to the weight of the upper gripper plates 32 and hence relatively weak, the film F is pulled out of the film grippers 3B against their gripping force when the upper and lower belts 61 and 62 are activated, and the film F is transported to the packaging station S.

When the film F from the upper film roll FL is used for packaging, the operation of the packaging machine proceeds similarly, and since the force of the permanent magnet 35 for the upper film grippers 3A is also relatively weak, the film feeder 6 can pull the film F and carry it to the packaging station S against the gripping force on the film F from the grippers 3A. While the film F is thus pulled out and transported by the film feeder 6, the arm 55*a* swings to the left (as shown in FIG. 9) and, after the film grippers 3B are retracted from the film-supplying position P5 to the wait position P4, the operation of supplying the film F to the packaging station S is completed. Thereafter, the cutter 21 is raised to cut the film F, and the packaging mechanism 11 of FIG. 12 is activated to carry out its operations. After the packaging operation is completed, the arm 55*a* (shown in FIG. 5) swings a little in a counter-clockwise direction to cause the film grippers 3B to slide from the wait position P4 back to the film-supplying position P5, starting another cycle of operations to repeat the packaging process.

In summary, the film supplying device 2 according to the present invention causes the film grippers 3A and 3B to be retracted back to the wait position P4 by the second gripper transporting device 5 while the film feeder 6 pulls out the film F. Thus, after each product is packaged, there is need for the film grippers 3A or 3B to move back to fetch the next film F. As a result, the film grippers 3A and 3B can be transported immediately to the film receiving section 60 of the film feeder 6 to supply the next film sheet to the film feeder 6. In other words, the period of cyclic operation for supplying film sheets is reduced and hence that for packaging can be also reduced.

Although the present invention has been described by way of only one example, this example is not intended to limit the scope of the invention. Many modifications and variations are possible within the scope of the invention. For example, the first gripper transporting devices 4A and 4B are not essential, although the film grippers 3A and 3B, according to the embodiment described above, are transported from the film-setting position P3 to the wait position P4 by the first gripper transporting devices 4A and 4B and to the film-supplying position P5 by the second gripper transporting device 5. It will be sufficient if the film grippers 3A and 3B are moved back and forth between the wait position P4 and the film-supplying position P5. As another example, the film F may be adapted to be set to the film grippers 3A and 3B at the wait position P4. As still another example, although FIG. 1 showed a packaging machine with a main structure at the center flanked by a pair of film supplying devices each holding two film rolls, and hence capable of using up to four films with different widths at the same time, there may be only one film supplying device of the type shown in FIG. 2 at one side of the main structure, or the main structure may be flanked by two film supplying devices each having only one film roll.

In summary, the present invention makes it unnecessary for the film grippers to travel all the way back to fetch the film at the beginning of each cycle of the packaging operations, and the film grippers are adapted to simply supply the film gripped by them to the film feeder. As a result, the period of the cyclic motion for supplying the film can be significantly reduced.

What is claimed is:

1. In combination with a packaging machine for causing a film feeder to grip a film and pull the film to a packaging station for packaging a product therewith, a film supplying device comprising:

gripper means for gripping the film; and gripper transporting means for guiding said film gripped by said gripper means to a film-receiving end of said film feeder by transporting said gripper means to a film-supplying position adjacent said film-receiving end and keeping said gripper means at a retracted position distal from said film feeder while said film is being pulled towards said packaging station by said film feeder, said gripper transporting means including first gripper transporting means for transporting said gripper means between said a film-supplying position and a wait position which are both distal from said film feeder and second gripper transporting means for transporting said gripper means between said wait position and said film-supplying position.

2. The film supplying device of claim 1 wherein said gripper transporting means include upper first gripper transporting means and lower first gripper transporting means, said upper first gripper transporting means being adapted to transport said gripper from an upper film-supplying position to said wait position, and said lower first gripper transporting means being adapted to transport said gripper from a lower film-supplying position to said wait position, said upper film-supplying position being higher than said lower film-supplying position.

3. The film supplying device of claim 1 wherein said gripper means include two side grippers separated from each other by a distance which is variable according to the width of said film to be gripped thereby.

4. The film supplying device of claim 3 wherein said two side grippers consist of a fixed gripper and a movable gripper which is movable towards or away from said fixed gripper.

5. The film supplying device of claim 3 wherein said two side grippers each comprise a lower gripper plate and an upper gripper plate which can open and close with respect to said lower gripper plate, said upper and lower gripper plates being adapted to grip said film sufficiently lightly therebetween such that said film feeder can pull said film against the gripping thereof by said gripper means.

6. The film supplying device of claim 4 wherein said fixed and movable grippers each comprise a lower gripper plate and an upper gripper plate which can open and close with respect to said lower gripper plate, said upper and lower gripper plates being adapted to grip said film sufficiently lightly therebetween such that said film feeder can pull said film against the gripping thereof by said gripper means.

7. The film supplying device of claim 1 further comprising a cutter for cutting said film disposed between said film-receiving end of said film feeder and said film-supplying position.

8. The film supplying device of claim 1 wherein a travel path is defined along which said film is guided from a film roll means to said film-receiving end of said film feeder, and wherein said gripper transporting means transport said gripper at least in part along said travel path.

9. The film supplying device of claim 8 wherein said gripper means grip front parts of said film with reference to said travel path.

10. The film supplying device of claim 1 wherein said gripper means include two side grippers separated from each other by a distance which is variable according to the width of said film to be gripped thereby.

11. The film supplying device of claim 10 wherein said two side grippers consist of a fixed gripper and a movable gripper which is movable towards or away from said fixed gripper.

12. The film supplying device of claim 10 wherein said two side grippers each comprise a lower gripper plate and an upper gripper plate which can open and close with respect to said lower gripper plate, said upper and lower gripper plates being adapted to grip said film sufficiently lightly therebetween such that said film feeder can pull said film against the gripping thereof by said gripper means.

13. The film supplying device of claim 11 wherein said fixed and movable grippers each comprise a lower gripper plate and an upper gripper plate which can open and close with respect to said lower gripper plate, said upper and lower gripper plates being adapted to grip said film sufficiently lightly therebetween such that said film feeder can pull said film against the gripping thereof by said gripper means.

14. The film supplying device of claim 7 wherein a travel path is defined along which said film is guided from a film roll means to said film-receiving end of said film feeder, and wherein said gripper transporting means transport said gripper at least in part along said travel path.

15. The film supplying device of claim 14 wherein said gripper means grip front parts of said film with reference to said travel path.

16. The film supplying device of claim 14 wherein said gripper means include two side grippers separated from each other by a distance which is variable according to the width of said film to be gripped thereby.

17. The film supplying device of claim 16 wherein said two side grippers consist of a fixed gripper and a movable gripper which is movable towards or away from said fixed gripper.

18. A device for supplying a film for a packaging machine having a packaging station, said film supplying device comprising:

a film feeder having a film-receiving end and being capable of tightly holding a film and pulling the film to said packaging station;

gripper means for gripping the film;

gripper transporting means for guiding said film gripped by said gripper means to said film-receiving end of said film feeder by transporting said gripper means to a film-supplying position adjacent said film-receiving end and keeping said gripper means at a retracted position distal from said film feeder while said film is being pulled towards said packaging station by said film feeder; and film feeder operating means for operating said film feeder to move said film towards said packaging station while said gripper means is kept at said retracted position.

19. The device of claim 18 of wherein a travel path is defined along which said film is guided from a film roll means to said film-receiving end of said film feeder, and wherein said gripper transporting means transport said gripper at least in part along said travel path.

20. The device of claim 18 wherein said gripper means grip front parts of said film with reference to said travel path.

* * * * *